US005697572A

United States Patent [19]

Salentine et al.

[11] Patent Number: 5,697,572

[45] Date of Patent: Dec. 16, 1997

[54] RETRACTABLE HOLDER

[75] Inventors: John Salentine; Kenneth Collin, both of Foster City, Calif.

[73] Assignee: Hammerhead Industries, Inc., Foster City, Calif.

[21] Appl. No.: 512,816

[22] Filed: Aug. 9, 1995

[51] Int. Cl.[6] ..... B65H 75/48

[52] U.S. Cl. ..... 242/379

[58] Field of Search ..... 242/379, 379.2, 242/398, 908, 404, 404.1, 404.2, 404.3, 406, 378.2

[56] References Cited

U.S. PATENT DOCUMENTS

| | | | |
|---|---|---|---|
| 812,150 | 2/1906 | McLean | 242/379 |
| 2,046,364 | 7/1936 | Bennett | 242/908 |
| 3,216,117 | 11/1965 | Stowell | 242/379 |
| 3,547,371 | 12/1970 | Gruseck | 242/379.2 |
| 4,407,460 | 10/1983 | Khudaverdian | 242/379.2 |
| 4,846,090 | 7/1989 | Palmquist | 242/379.2 |
| 4,969,610 | 11/1990 | Taylor et al. | 242/379.2 |
| 5,094,396 | 3/1992 | Burke | 242/378.2 |
| 5,490,805 | 2/1996 | Bredesen | 242/379 |

*Primary Examiner*—John M. Jillions
*Attorney, Agent, or Firm*—Michael G. Petit

[57] ABSTRACT

A tethering device for securely holding and extendably presenting an article, particularly an article such as scuba diving equipment and the like required for activities performed in extreme environments. The device includes a durable body-mountable plastic case housing a cord-retracting mechanism. One end of a tethering cord is attached to the cord-retracting mechanism. The other end of the cord extends through a guide hole in the case and has means thereon for attachment to an article such as a tool thereby tethering the article to the case. The tethered article may be extended for use at arms length then automatically retracted toward the case by the coil spring retracting mechanism. The case housing the retracting mechanism and cord also includes means for attaching the device to a user. In one embodiment the back of the case contains a removable mounting plate. A strap or belt may be sandwiched between the case and mounting plate to securely attach the device to the belt. The wall of the case has two flushing holes extending therethrough positioned to permit removal of water and debris from the internal winding mechanism without disassembly. The flushing holes also provide a means for cleaning the device and allowing the cord retracting spring mechanism enclosed within the case to dry. The device is particularly adapted for use as a retractable tether for tools used in extreme environments such as underwater diving equipment.

12 Claims, 3 Drawing Sheets

RETRACTABLE HOLDER

BACKGROUND OF THE INVENTION

1. Field of the Invention

The present invention relates to an apparatus for storing and presenting a retractable cord and more particularly to a retractable tether adapted for holding tools used in aqueous environments.

2. Prior Art

In equipment-intensive activities, where the loss of equipment is both common and dangerous such as scuba diving or performing tasks at high elevations or in deep snow, a reliable means for securing essential tools or equipment to ones body is desirable. If the tool or equipment is not attached or tethered to the user in some manner, it may be lost. Tools and equipment used in sports such as scuba diving and fishing are commonly attached to ones body or gear by tethering means consisting of fixed-length strings or cords referred to as lanyards. Tools and similar equipment, collectively referred to herein as "articles", are attached to such a lanyard and then looped, cinched, or tied to an extremity or clipped to ones equipment or clothing. In order to use such a tethered article at arms length without detaching the article from the tether, such lanyards must either be long or attached to an extremity such as the wrist to allow use of the tool equipment. Thus, the use of fixed-length lanyards to tether articles may cause tanglement if the tether is long enough to present the article for arms length use and or inconvenient and cumbersome if affixed to the wrist.

In response to the entanglement problem encountered with fixed length lanyards, spiral or coil-type lanyards have been developed to shorten the effective length of the lanyard when the tethered article is not in use. This type of lanyard reduces entanglement by reducing the effective length of the lanyard. However, the tethered tool or equipment will dangle when not in use causing at least partial extension of the tethering cord resulting in possible tanglement.

Automatic winding mechanisms such as seat belt retractors, electrical cord retractors, and key ring retractors are commonly employed to overcome some of the problems encountered with lanyard-type article tethers such as entanglement. The retracting mechanism of such retractable tethering devices employ coiled springs which are well known in the art. These devices do not generally provide means for reducing or eliminating mechanism failure due to exposure to particulate contaminants commonly encountered in extreme environments. Key-chain retractors, used for securely and extensibly tethering keys to a persons body, generally do not have the restoring force necessary for retracting heavier tools such as a flashlight or an abalone iron. Moreover, the retracting mechanism of such prior art retractable tethering devices is easily jammed by invasive environmental particle contaminants such as sand.

Retracting devices adapted for water-type applications such as water-ski tow ropes (see, for example U.S. Pat. 4,407,460 4,969,610) are known in the art. These devices provide means for removing certain debris and water from the retracting line before such debris enters the internal winding mechanism. One such device (U.S. Pat. 4,407,460) incorporates a drain hole in the bottom of the case to allow water to drain from the case housing the retracting mechanism. These devices, while useful for preventing certain contaminants from entering the case and permit the (passive) draining of water form the interior of the case, do not provide means for the active removal of contaminants which do enter the case during use such as sand, mud, and water.

None of prior art devices provide a jam-proof, flushable, retractable tethering device operable for securely holding and retractably presenting articles and adapted for use in harsh environments. None of the above devices present a retractable tethering device which provides mean for internal flushing of particulates from the case without disassembly of the case.

SUMMARY OF THE INVENTION

The body or equipment-mountable retractable tethering device of the present invention consists of a portable body-mountable case defining an enclosed interior space and having a guide hole in the wall thereof through which guide hole the free end of a retractable cord projects. The case encloses a cord retracting mechanism comprising a ring-shaped reel affixed to a coil-type non-corrosive spring. The fixed end of the cord (or "tether") opposite the free end is attached to the outer perimeter of the reel. The free end of the cord projects through the guide hole in the case. The reel cord-retracting mechanism enables the coil spring to be wound or tensioned by is forcefully extending the free end of the cord from the case. The tension in the wound spring applies a tangential restoring force to the reel causing the reel to rotate thereby retracting the cord into the case thereafter to be wound onto the outer perimeter of the reel to which the fixed end of the cord is attached. The interior wall of the case includes a pair of opposed smooth raised circular bearing surfaces between which the reel rotates and which minimizes friction permitting continuous operation of the spring cord-retracting mechanism even when the case interior is exposed to debris. The coil spring is disposed within the inner circumference of the annular cord-winding reel. One end (the outer end) of the coil spring is attached to the reel and the other end attached to an axially mounted arbor post affixed to the case. A clip operable for releasably attaching a tool is attached to the free end of the cord (the end of the cord extending through the guide hole in the case). The clip may comprise a split ring, side release type clip, a carabiner or some other attachment means operable for releasably and securely attaching to an article.

A slot or similar means in the wall of the case provides an attachment for a belt or a strap; which belt, in turn, can be securely attached to ones body or body-mounted equipment. In one embodiment, the case includes a mounting bracket which can be securely attached to a body-mountable belt either by sandwiching a portion of the belt between the mounting bracket and the case of the device or by looping a strap through slots in the mounting bracket once the bracket is attached to the case of the device. The case contains two flushing holes positioned on the same side of the case as the cord hole which allow water and debris to be flushed from the internal mechanism by the movement of the reel. In addition, an embodiment of the device of the present invention may include a lock mechanism which enables the user to lock the extended tethering cord at a preferred length to position a article (affixed to the free end of the tether) at a convenient working distance from the case.

In summary, the invention provides a retractable article-tethering device which will operate reliably even when exposed to ice or snow or to water-dispersed contaminants such as suspended sand, mud and salt chlorine water during submersion. In addition, the device can be securely attached to a person's body or equipment by including versatile mounting means on the case. The provision of versatile means for attaching various articles to the free end of the tethering cord is also desirable. The attachment means are chosen to avoid inadvertent loss of the device and or articles attached thereto. The present device provides the user with compact body-mountable means for carrying an article such as a tool, while providing means operable for extending the article for use without the concern for loss. When the user is finished using the article, the article will automatically retract toward the case due to the restoring force applied by the coil spring. The tethering cord retracts into the case, thereafter to remain wound upon a reel and available for use at a later time. The device reduces or prevents tether cord entanglement by keeping the tethering cord wound upon a reel within the case when the article is not in use.

In accordance with the foregoing summary of the invention it is a primary object of the invention to provide a body mountable retractable article tethering device adapted for reliable operation in extreme environments.

It is another object of the invention to provide a retractable body mountable article-tethering device having means for flushing particulate contaminants from the case without disassembly.

The features of the invention believed to be novel are set forth with particularity in the appended claims. However, the invention itself, both as to organization and method of operation, together with further objects and advantages thereof may best be understood by reference to the following description taken in conjunction with the accompanying drawings in which:

DESCRIPTION OF THE PREFERRED EMBODIMENTS

Figure 1:
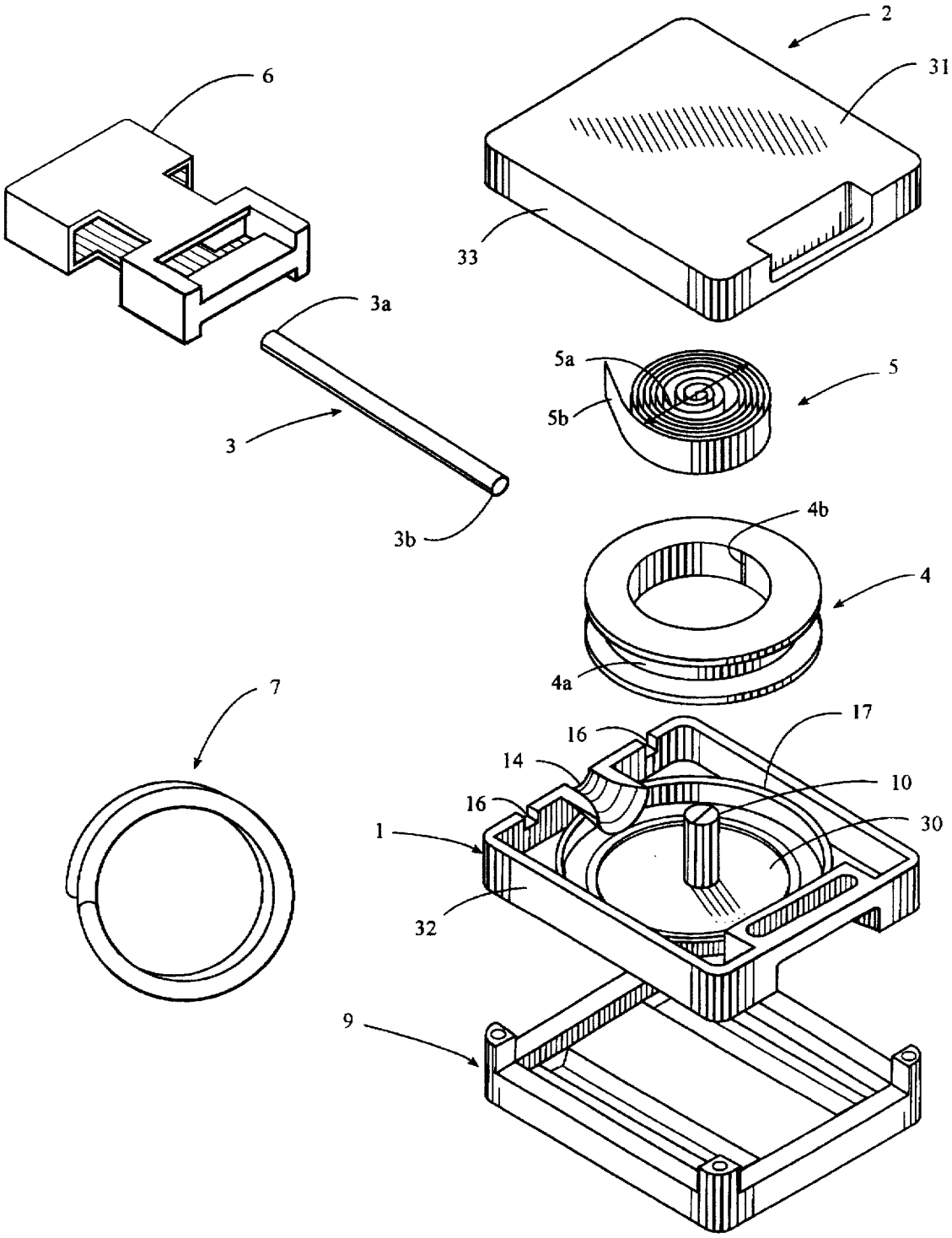
FIG. 1 is an exploded perspective view showing the elements of a preferred embodiment of the invention.
Figure 9:
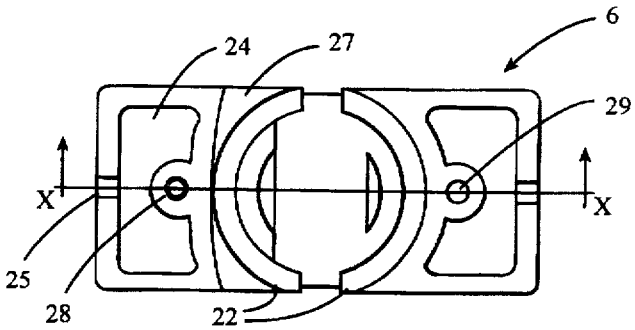
FIG. 9 is a plan view of the clip.
Figure 10:
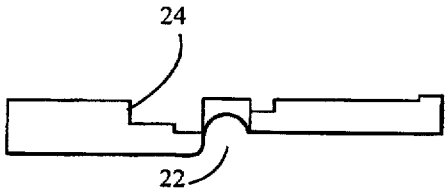
FIG. 10 is a transverse sectional view of the clip taken along the IX—IX of FIG. 9.

With reference now to FIG. 1, top case half the device, broken apart to show the organization of the component thereof, comprises a clam-shell type case having a bottom half 1 and a top half 2 which halves matingly engage with each other to enclose an interior space. The bottom half 1 and top half 2 comprise exterior planar end portions 30 and 31, respectively, each surrounded by perimeter walls 32 and 33, respectively, which extend upwardly from the perimeters of the planar end portions 30 and 31 and which seat together to form the clam-shell type case. A portion of one or both of the case halves, and 2 is preferably transparent to permit viewing of the interior space (the inside of the case when the case halves 1 and 2 are joined together) and inspect the inner components for contaminants without disassembling the case. A tethering line 3 (also referred to herein as a "cord" or a "tether") has a free end 3*a* and a fixed end 3*b* which is securely fastened to the outer perimeter of a reel 4. The reel 4 is a ring shaped member, the outer perimeter comprising an annular outer surface 4*a* upon which surface the cord 3 is wound, and an annular inner surface 4*b*. A portion of the inner surface 4*b* of the reel 4 is slatted to receive the outer end 5*b* of a coil spring 5. The coil spring 5 has a fixed inner end 5*a* non-releasably attached to a slotted stationary arbor 10 affixed to the bottom half 1 of the case. The free end 3*a* of the line 3 is affixed to a clip 6 (see FIG. 9) adapted to securely attach to a split ring 7 or a side release clip 6. A body-mounting bracket 9, adapted to provide a slot for permit the attachment of the case to a user belt (not shown) or similar accessory may be fastened to the bottom half 1 of the case.

When the top half 2 and bottom half 1 halves are joined together to form the case, the slotted arbor 10 forms a central axis of rotation for the reel 4 which rotation is operable for rolling the line 3 upon the reel outer surface 4*a*. The arbor 10 is slotted to receive and securely hold the inner fixed end of the power coil spring 5 which is disposed within the inner perimeter of the annular reel 4. The inner surface 4*b* of the reel 4 has a slot 4*c* therein dimensioned to receive and hold the outer end 5*b* of the coil spring 5.

Figure 3:
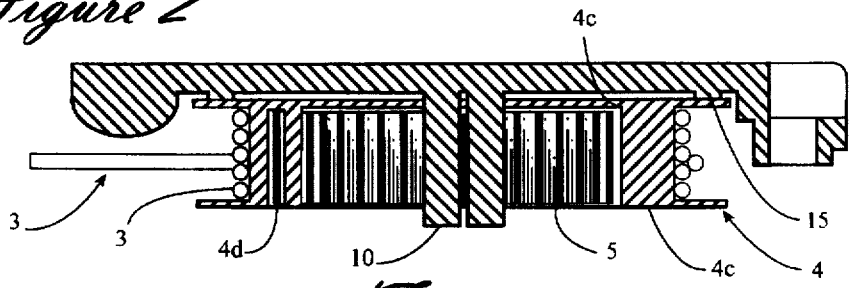
FIG. 3 is a transverse sectional view of the bottom half-shell case taken along section line V—V of FIG. 2.
Figure 4:
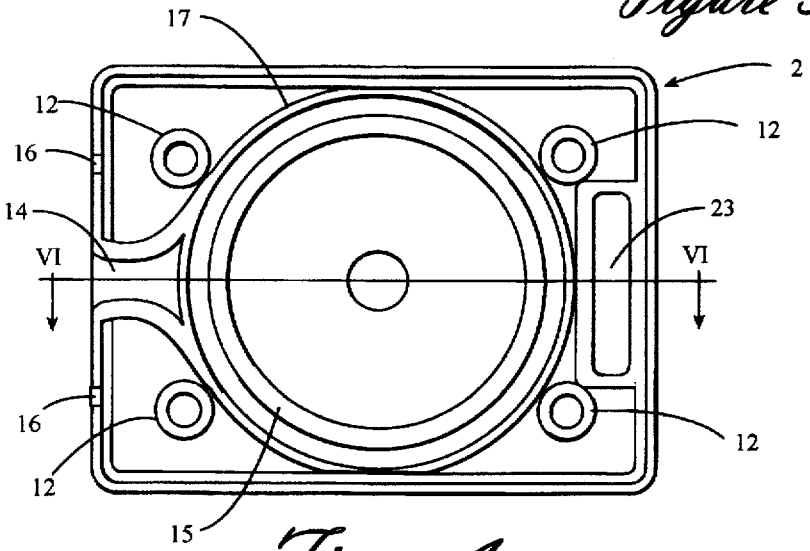
FIG. 4 is a top plan view of the top half of the case.
Figure 5:
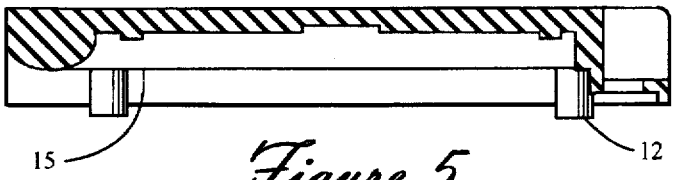
FIG. 5 is a transverse sectional view of the top half-shell case taken along line VI—VI of FIG. 4.

The upper half 2 of the case shown in detail in FIGS. 4 and 5, contains hollow pillars 12 thereon which support the lower half 1 of the case. The lower half 1 of the case (see FIGS. 2 and 3) has holes 13 drilled therethrough for receiving case-half connecting means, such as screws, for attaching the lower half 1 of the case to the upper half 2.

Each half of the case has a semicircular groove 14 therein. When the case is assembled, the semicircular grooves 14 in the respective halves of the case juxtapose to form a circular guide hole (not shown) having a smooth surface for the line 3 to slide through.

With reference now to FIGS. 2, 3, 4, and 5, each case half 1 and 2 has a raised annular bearing surface 15 thereon which supports and stabilizes the reel 4, providing a low-friction close fitting surface for the rim wall 4*c*of the reel 4 to rotate against permitting rotation of the reel 4 even in the presence of contaminating particles and other debris.

Each case half has rectangular slots 16 which, when the case is assembled, are juxtaposed to form flush holes through the case. The rectangular slots 17 are formed in the perimeter walls 32 and 33. The flush holes 16 facilitate the flushing of debris from the mechanism. In addition, each case half provides an open flow channel between holes 16 and the outer surface 4*a* of the reel 4, allowing water and debris to be flushed from the (assembled) case interior by the rotary motion of the reel. A cavity wall 17 (FIG. 2) forms a physical barrier around the reel 4 and coil spring 5. The cavity wall 17 is instrumental for reducing the flow of debris around the reel and spring and for preventing sand from entering the interface between the reel 4 and the annular bearing surface 15.

Figure 2:
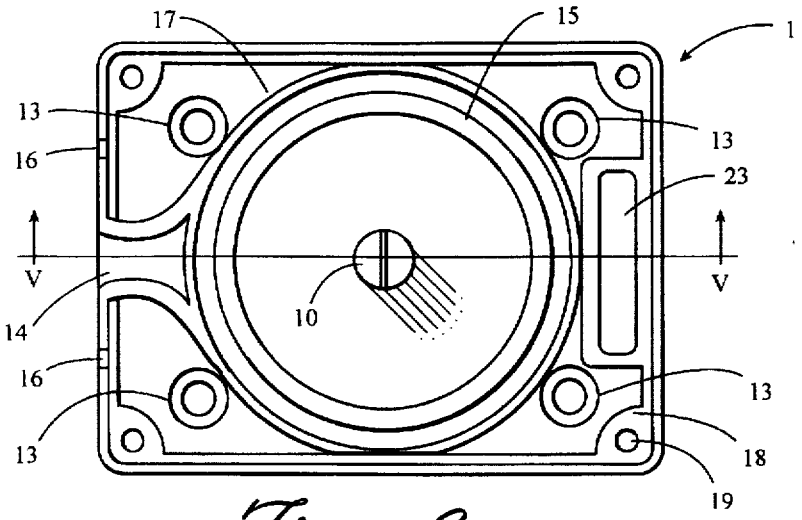
FIG. 2 is a top plan view of the bottom half of the case.
Figure 6:
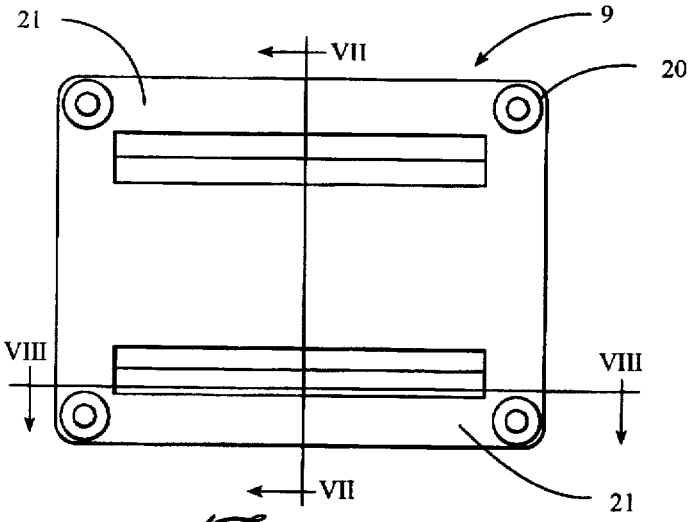
FIG. 6 is a plan view of an embodiment of the body-mounting bracket.
Figure 7:
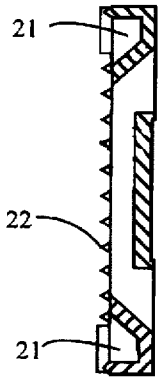
FIG. 7 is a transverse sectional view of the body-mounting bracket taken along section line VII—VII of FIG. 6.
Figure 8:
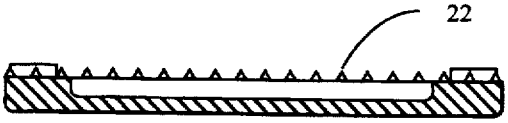
FIG. 8 is a transverse sectional view of the mounting bracket taken along section line VIII—VIII of FIG. 6.

The lower half 1 of the case, shown in FIG. 2, has reinforced portions 18 having holes 19 (FIG. 2) therein. The body-mounting bracket 9 (FIG. 6) has holes 20 therethrough which provide a means for inserting screws (not shown) into mating screw receiving holes 19 in the bottom half 1 of the case. Slots 21 in the body-mounting bracket 9 (FIG. 6) are angled, as shown in FIGS. 6 and 7, to allow passage of a strap (not shown) therethrough when the body-mounting bracket 9 is secured to the lower half 1 of the case. Gripping means 22 such as a rough surface or multiple pointed members protrude from the rear face of the mounting bracket to present a gripping, non-slip surface when a strap or belt (not shown) is inserted between the lower half 1 of the case and the body-mounting bracket 9.

A portion of the contacting edge of each half of the case has half of a slot 23 (FIGS. 2 and 4) therein which, when in the case is assembled, form a slot in the case operable for receiving nylon-type webbing or means for securing the case to a clip type mechanism.

The clip 6 (FIG. 9), which attaches to the free end 3a of the cord 3, has a cavity 24 dimensioned to receive and house a knot (not shown) formed at the free end s of the cord 3 which enters the clip through an opening 25 in the cavity 24. Clip 6 has a split ring groove 22 and a side release groove 27 operable for receiving and housing a split ring 7 or a side release clip (not shown). Clip 6 contains an integrated hollow post 28 and hole 29 which, when the clip 6 is folded in half, provides means for screwing the opposing halves of the clip together. Folding clip 6 in half seals the cavity 24 and forms a secure opening 25 through which the line 3 passes. Folding clip 6 in half also sandwiches a split ring 7 or side release clip (not shown) in grooves 25 or 26 respectively, thereby securing the split ring or side release clips to the line.

While the foregoing referred embodiments of the invention have been described and shown, it is understood that alternatives and modifications such as those suggested and other, may be made thereto and fall within the scope of the invention. For example, the flushing holes in the case may be provided with means for closing to reduce ingress of contaminants during use. The flushing holes may be opened for flushing when particulate contaminants are present inside the case then closed or left open to air dry the case interior. There may be one or more windows enabling noninvasive invasive inspection of the winding mechanism. The entire case may be transparent. It is, therefore, intended to cover in the appended claims all such changes and modifications that are within the scope of this invention.

What we claim:

1. In a retractable tethering device comprising: (a) an outer case having planar end walls and perimeter side walls; (b) a retracting mechanism enclosed within the outer case, and (c) a tethering cord having a fixed end attached to said retracting mechanism and a free end projecting through a guide hole in said wall of said outer case, the device being operable for presenting a length of tethering cord in response to tension applied to said free end of said tethering cord and for retracting the length of tethering cord into said outer case when the tension applied to said free end of the tethering cord is relaxed, the improvement comprising a cavity wall comprising a substantially annular member encircling a perimeter of said retracting mechanism and flushing means operable for removing a contaminant from inside said outer case, said flushing means comprising two flushing holes formed through the perimeter side walls of said outer case.

2. The retractable tethering device of claim 1 wherein said flushing means comprises first and second holes in said wall of said outer case, wherein said first hole is operable for receiving and conducting an externally introduced flushing fluid into said outer case and wherein said second hole is operable for draining the externally introduced flushing fluid from within said outer case.

3. The improved retractable tethering device of claim 1 wherein at least a portion of said outer case is transparent.

4. The retractable tethering device of claim 2 wherein at least a portion of said outer case is transparent.

5. The retractable tethering device of claim 1 wherein said guide hole is an opening in said cavity wall.

6. The retractable tethering device of claim 1 wherein said guide hole is an opening in said cavity wall.

7. In a retractable tethering device comprising: (a) an outer case having planar end walls and perimeter side walls; (b) a retracting mechanism enclosed within the outer case, and (c) a tethering cord having a fixed end attached to said retracting mechanism and a free end through a guide hole in said wall of said outer case, the device being operable for presenting a length of tethering cord in response to tension applied to said free end of said tethering cord and for retracting the length of tethering cord into said outer when the tension applied to said free end of the tethering cord is relaxed, the improvement comprising: (a) flushing means on said device operable for removing a particulate contaminant from inside said outer case, said flushing means comprising a pair of holes formed through the perimeter side walls of the outer case; and (b) a cavity wall affixed to outer case and positioned thereon to form a barrier around said retracting mechanism, and wherein said cavity wall comprises a substantially annular member encircling the perimeter of the retracting mechanism and wherein said guide hole is an opening in said cavity wall.

8. The retractable tethering device of claim 7 wherein said flushing means comprises first and second holes in said wall of said outer case, wherein said first hole is operable for receiving and conducting an externally introduced flushing fluid into the outer case and wherein said second hole is operable for draining the externally introduced flushing fluid from within the said outer case.

9. The improved retractable tethering device of claim 7 wherein at least a portion of said case is transparent.

10. The retractable tethering device of claim 8 wherein at least a portion of said outer case is transparent.

11. A retractable tethering device comprising:

an outer case having planar end walls and perimeter aide walls with a guide hole formed therethrough, flushing means holes formed therethrough operable for removing a contaminant from inside said outer case, said flushing means comprising first and second holes formed in the perimeter side walls of the outer case, wherein the first hole is operable for receiving and conducting and externally introduced flushing fluid into the outer case and wherein the second hole is operable for draining the externally introduced flushing fluid from within the outer case, and internally positioned raised annular surfaces;

a tethering cord having a fixed end and a free end; and a retracting mechanism enclosed within said outer case, said retracting mechanism comprising a ring-shaped reel having an inner opening into which a spring means fits, an outer perimeter onto which said tethering cord is adapted to wrap, and rim walls adapted to ride adjacent said internally positioned raised annular surfaces of said outer case;

wherein said fixed end of said tethering cord is attached to said retracting mechanism and said free end projects through said guide hole, the device being operable for presenting a length of tethering cord in response to tension applied to said free end of said tethering cord and for retracting the length of tethering cord into said outer case when the tension applied to said free end of the tethering cord is relaxed.

12. In a retractable tethering device comprising: (a) an outer case having planar end walls and perimeter side walls; (b) a retracting mechanism enclosed within the outer case, and (c) a tethering cord having a fixed end attached to said retracting mechanism and a free end projecting through a guide hole in said wall of said outer case, the device being operable for presenting a length of tethering cord in response to tension applied to said free end of said tethering cord and for retracting the length of tethering cord into said outer case when the tension applied to said free end of the tethering cord is relaxed, the improvement comprising a cavity wall comprising a substantially annular member encircling a perimeter of said retracting mechanism and flushing means operable for removing a contaminant from inside said outer case, said flushing means comprising first and second holes formed through the perimeter side walls of the outer case, wherein the first hole is operable for receiving and conducting an externally introduced flushing fluid into the outer case and wherein the second hole is operable for draining the externally introduced flushing fluid from within the outer case.

* * * * *